US008910327B2

(12) United States Patent
Jin

(10) Patent No.: US 8,910,327 B2
(45) Date of Patent: Dec. 16, 2014

(54) ADJUSTABLE FOLDING BED FRAME

(76) Inventor: Ki Ho Jin, Xiamen (CN)

( * ) Notice: Subject to any disclaimer, the term of this patent is extended or adjusted under 35 U.S.C. 154(b) by 155 days.

(21) Appl. No.: 13/316,077

(22) Filed: Dec. 9, 2011

(65) Prior Publication Data

US 2012/0304380 A1 Dec. 6, 2012

Related U.S. Application Data

(63) Continuation-in-part of application No. 12/655,565, filed on Dec. 30, 2009, now Pat. No. 8,091,160.

(30) Foreign Application Priority Data

Mar. 17, 2009 (CN) ..... 2009 2 0137197 U

(51) Int. Cl.
*A47C 19/12* (2006.01)
*A47C 19/00* (2006.01)

(52) U.S. Cl.
CPC ..... *A47C 19/126* (2013.01)
USPC ..... 5/174; 5/175; 5/181; 5/200.1; 5/201; 5/202

(58) Field of Classification Search
USPC ..... 5/112–117, 174–185, 200.1–202
See application file for complete search history.

(56) References Cited

U.S. PATENT DOCUMENTS 589,482 A * 9/1897 Rimmelin ..... 5/117
648,304 A 4/1900 Routier
718,159 A 1/1903 Rundgvist
810,718 A * 1/1906 Clark ..... 5/95
1,100,701 A * 6/1914 Kreuzkamp ..... 5/193
1,122,284 A 12/1914 Kyle
1,167,123 A 1/1916 Sinclair
1,204,792 A 11/1916 Kyle
1,323,257 A * 12/1919 Dudek ..... 5/183
1,394,331 A * 10/1921 Monroe ..... 5/183
1,409,380 A 3/1922 Irwin et al.
1,577,204 A 3/1926 Davis (Continued)

FOREIGN PATENT DOCUMENTS

CN 2376227 Y 5/2000
CN 2684640 Y 3/2005

(Continued)

OTHER PUBLICATIONS

International Search Report, PCT/CN2007/001842, Dec. 25, 2007.

*Primary Examiner* — Peter M Cuomo
*Assistant Examiner* — Ifeolu Adeboyejo
(74) *Attorney, Agent, or Firm* — John H. Choi

(57) ABSTRACT

An adjustable folding bed frame including a plurality of longitudinal beams spaced apart and parallel to each other. Each longitudinal beam is formed by a pair of longitudinal bars that are pivotally connected together. The bed frame also includes a plurality of transverse beams spaced apart and parallel to each other. Each transverse beam is formed by a pair of transverse bars that are pivotally connected together. Each transverse bar has a first sliding member slidingly coupled with a second sliding member for adjusting the bed frame to predetermined widths. The bed frame also includes legs connected to a corresponding lower side of each longitudinal bar free end. The longitudinal and transverse bars are coupled together to form a generally rectangular frame when the bed frame is in an open configuration, and are folded adjacent and parallel to each other when the bed frame is in a folded configuration.

1 Claim, 11 Drawing Sheets

(56) References Cited

U.S. PATENT DOCUMENTS

| | | | | | |
|---|---|---|---|---|---|
| 1,577,205 | A | | 3/1926 | Davis | |
| 1,602,115 | A | | 10/1926 | Malis | |
| 1,693,537 | A | | 11/1928 | Adkins et al. | |
| 1,763,447 | A | | 6/1930 | Schilling | |
| 1,810,311 | A | | 6/1931 | Frey | |
| 1,876,743 | A | * | 9/1932 | Pilates | 5/131 |
| 2,590,129 | A | * | 3/1952 | Sawaya | 5/176.1 |
| 2,591,551 | A | * | 4/1952 | Kaplan | 5/110 |
| 3,967,330 | A | | 7/1976 | Zawadowsky | |
| 4,070,717 | A | | 1/1978 | Kitchen et al. | |
| 4,106,141 | A | * | 8/1978 | Hooker | 5/201 |
| 4,243,263 | A | * | 1/1981 | Thiboutot | 297/42 |
| 4,670,921 | A | | 6/1987 | Avni et al. | |
| 5,711,040 | A | | 1/1998 | Huang | |
| 5,718,254 | A | * | 2/1998 | Murphy | 135/96 |
| 5,911,653 | A | * | 6/1999 | Cheng | 5/99.1 |
| 6,134,727 | A | | 10/2000 | Hwang | |
| 6,338,172 | B1 | * | 1/2002 | Taylor et al. | 5/200.1 |
| 6,397,412 | B1 | * | 6/2002 | Quintile | 5/200.1 |
| 6,553,586 | B1 | | 4/2003 | Lin | |
| 6,581,223 | B1 | | 6/2003 | Wang | |
| 6,618,879 | B1 | | 9/2003 | Wu | |
| 6,810,540 | B2 | * | 11/2004 | Harrow | 5/184 |
| 7,134,154 | B2 | | 11/2006 | Cloer et al. | |
| 2006/0174415 | A1 | | 8/2006 | Moulton | |
| 2008/0168602 | A1 | * | 7/2008 | DiForio | 5/184 |
| 2010/0299831 | A1 | * | 12/2010 | Lee | 5/202 |

FOREIGN PATENT DOCUMENTS

| | | | |
|---|---|---|---|
| CN | 2902036 | Y | 5/2007 |
| GB | 2240034 | A | 7/1991 |
| GB | 2360700 | A | 10/2001 |
| JP | 4073008 | A | 3/1992 |

* cited by examiner

ADJUSTABLE FOLDING BED FRAME

This application is a continuation-in-part of U.S. patent application Ser. No. 12/655,565 filed on Dec. 30, 2009 now U.S. Pat. No. 8,091,160 ("'565 application"), which is incorporated by reference in its entirety.

FIELD OF THE INVENTION

The present invention relates to the field of bed support frames for supporting mattresses, and more particularly to bed frames that are adjustable to fit and support a range of mattress sizes. The present invention also relates to bed frames that are capable of being folded into a compact state for convenient transport and storage.

BACKGROUND OF THE INVENTION

Conventional beds generally include a frame, a box spring that is supported by the frame and a mattress that rests on top of the box spring. Conventional frames generally consist of a head rail, foot rail and two pairs of spaced, parallel side rails that form a rectangle that conforms to the shape of the box spring to be placed thereon. The rails support the outer periphery of the box spring mattress.

Although sufficient for most smaller beds, the rectangular configuration fails to sufficiently support the center of most larger beds, such as queen or king-sized beds. Most of the weight of a sleeper rests on the center portion of the bed and a lack of support in the center portion can result in bowing of the mattress and instability. Such bowing and instability of the mattress can result in discomfort for the sleeper and excessive wear on the mattress and bed frame.

Therefore, bed frames are sold with separate cross-rail supports to provide support to the center portion of the bed. One or more metal cross-rail supports are assembled to rest on the side rails of the frame and extend along the width of the bed, or on the head rail and foot rail and extend along the length of the bed. Further support for the mattress may be achieved by using a leg, or legs, attached to the cross-rail. The legs rest on the floor and are located beneath the support zone of the bed, supporting the cross-rail from below.

Furthermore, to accommodate the large number of bed widths, the cross-rail supports (and head rail and foot rail) are adjustable to allow the transverse cross-rail supports (and head rail and foot rail) to be lengthened or shortened to support different sized beds.

Even though the cross-rail supports are adjustable, the length of the side rails, which may exceed six feet, cannot be adjusted. Therefore, the bed frames are packaged and sold with a minimum length of six feet or longer. Such packaging causes great inconvenience. For example, the retailer must dedicate much needed additional valuable shelf space for the product. As another example, transporting the product is difficult for the consumer because of its length. In other words, transport of the product is not possible in a trunk of an automobile and therefore the consumer is required to have a larger vehicle or have the bed frame shipped, incurring additional shipping costs. As yet another example, storing the product when the bed frame is not in use is difficult because of the length of the frame.

Another problem with conventional bed frames occurs during the process of adjusting the width of the bed frame. The cross-rail supports of conventional bed frames must be assembled and adjusted while the bed frame is fully opened. It is often times difficult to adjust the width of each cross-rail support due to the geometrical constraints of the bed frame.

Therefore, it would be advantageous to have a bed frame capable of compact folding for easy transport and storage. Furthermore, it would be advantageous if the width of the bed frame was easy to adjust.

BRIEF SUMMARY OF THE INVENTION

The present invention addresses the above needs and achieves other advantages by providing an easily adjustable bed frame capable of reducing its structural components to a significantly more compact arrangement by folding or otherwise collapsing the metal bed frame into a configuration having a reduced size, so that the folded frame occupies minimal space during storage and/or transportation, which can further reduce costs to the retailer and consumer.

In order to achieve the above advantages, the present invention provides an adjustable folding bed frame comprising a plurality of longitudinal beams spaced apart and parallel to each other. Each longitudinal beam is formed by a pair of longitudinal bars, each having a free end and an inner end. Adjacent inner ends of each of the pair of longitudinal bars are pivotally connected together by a first pivotal coupling member. The bed frame further comprises a plurality of transverse beams spaced apart and parallel to each other. Each transverse beam is formed by a pair of transverse bars having a first end and a second end, and each transverse bar is formed by a first sliding member slidingly coupled with a second sliding member. Adjacent first ends of each pair of transverse bars are pivotally connected together by a second pivotal coupling member. Opposing transverse bar second ends of each of at least two transverse beams are pivotally connected to the longitudinal bar free ends of the at least two opposing longitudinal beams by a third pivotal coupling member to form a generally rectangular frame when the bed frame is in an open configuration. The bed frame further comprises a plurality of legs at least connected to a corresponding lower side of each longitudinal bar proximate the free ends.

In one embodiment, the first sliding member is a shaft and the second sliding member is a sleeve. The shaft is configured such that it is slidable within the sleeve, and a locking member is disposed within the shaft and extends through a locking aperture of the shaft such that the locking member is engageable with each positioning aperture of the sleeve corresponding to a predetermined width of the bed frame.

In another embodiment, the first sliding member is a sleeve and the second sliding member is a shaft. The shaft is configured such that it is slidable within the sleeve, and a locking member is disposed within the shaft and extends through each positioning aperture of the shaft such that each locking member is engageable with a locking aperture of the sleeve.

Another embodiment of the bed frame includes a third transverse beam. Each transverse bar second end of the third transverse beam is fixedly coupled to each of the first pivotal coupling members of the at least two opposing longitudinal beams.

Yet another embodiment of the invention is a method for folding the bed frame of the preceding paragraph from the open configuration to a folded configuration. The method includes rotating the pair of transverse bars of each transverse beam downward with respect to each respective second pivotal coupling member such that the transverse bars of each transverse beam are substantially parallel and adjacent to each other, and the opposing longitudinal beams are substantially parallel and adjacent to each other; rotating each of the transverse bars of the first and second transverse beams inward with respect to each respective third pivotal coupling member such that each pair of transverse bars of each of the first and second transverse beams are substantially parallel and adjacent to corresponding longitudinal bars; and rotating each pair of opposing longitudinal bars inward with respect to each respective first pivotal coupling member such that the transverse bars and longitudinal bars of the bed frame are collectively substantially parallel and adjacent to each other.

Another embodiment of the invention includes a pivotal coupling member comprising three U-shaped members. Each U-shaped member has a substantially rectangular bottom plate having opposing longitudinal and lateral ends. A pair of opposing side plates extend normal from opposing longitudinal ends of the bottom plate to form an opening between the opposing side plates. The first U-shaped member is positioned such that the opposing side plates extend upward. The second and third U-shaped member bottom plates are each fixedly coupled normal to a bottom portion of opposing lateral ends of the first U-shaped member bottom plate, and each pair of side plates of the second and third U-shaped members extend outward from the first U-shaped member. The inner side plates of the second and third U-shaped members are substantially aligned along a central lateral axis of the first U-shaped member. Each transverse bar first end of each transverse beam is pivotally coupled to each second and third U-shaped member, respectively, such that said transverse bars engage the first U-shaped member bottom plate when the bed frame is in an open configuration and said transverse bars engage the second and third U-shaped member bottom plates when the bed frame is in a closed configuration.

In another embodiment of the invention, the bed frame includes a third longitudinal beam. Each longitudinal bar free end of the third longitudinal beam is pivotally coupled to the second pivotal coupling members of the at least two opposing transverse beams.

Yet another embodiment of the invention is a method for folding the bed frame of the preceding paragraph from the open configuration to a folded configuration. The method includes rotating each pair of transverse bars of each transverse beam inward with respect to the third pivotal coupling member; simultaneously rotating the longitudinal bars of the third longitudinal beam downward with respect to the second pivotal coupling members of each transverse beam such that opposing transverse bars of each transverse beam and corresponding opposing longitudinal bars are substantially parallel and adjacent to each other, and the longitudinal bars of the third longitudinal beam are substantially parallel and adjacent to each other and positioned substantially perpendicular to the first and second longitudinal beams; and rotating each pair of opposing longitudinal bars of the first and second longitudinal beams downward with respect to each first pivotal coupling member such that the transverse bars and longitudinal bars of the bed frame are collectively substantially parallel and adjacent to each other.

Another embodiment of the present invention includes a pivotal coupling member comprising a pair of opposing plates each having a first end and a second end. Each plate is fixedly coupled by an intermediate member to form an opening between the opposing plates. A pair of opposing side extensions extend from outer sides of each plate. Each longitudinal bar free end of the third longitudinal beam is pivotally coupled to the second ends of the pair of opposing plates, and the transverse bar first ends of each transverse beam are each pivotally coupled to the opposing pair of side extensions.

BRIEF DESCRIPTION OF THE DRAWINGS

Further advantages and features of the present invention will become apparent from the detailed description of the invention with reference to the accompanying drawings, in which.

Figure 1:
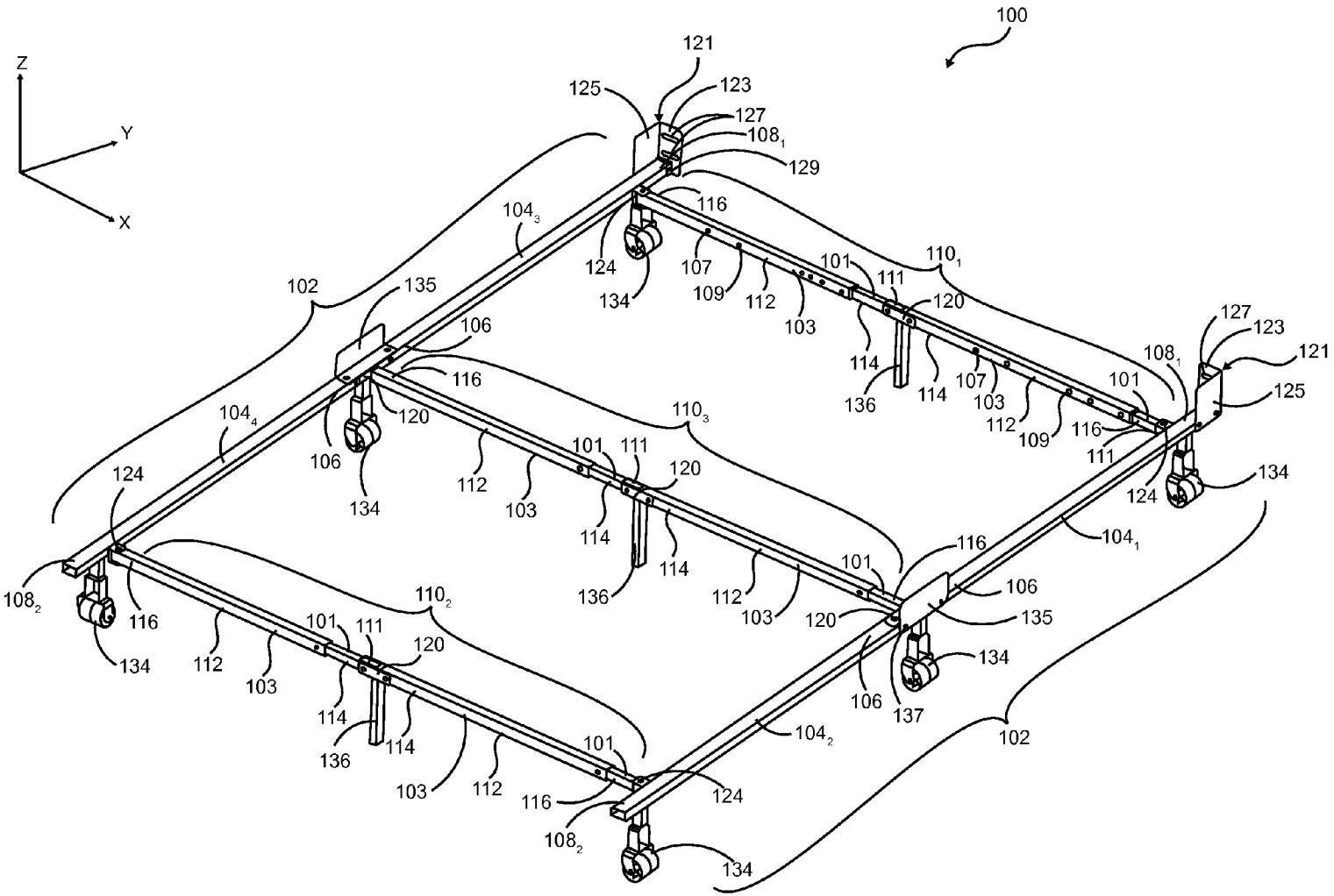
FIG. 1 is a top perspective view illustrating a first embodiment of an adjustable folding bed frame of the present invention in a completely expanded state.

To facilitate an understanding of the invention, identical reference numerals and component descriptions have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

First Embodiment

Figure 3:
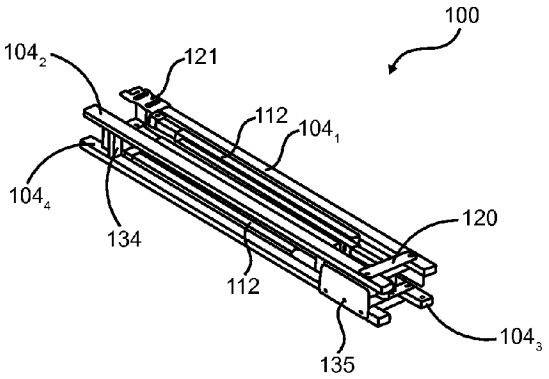
FIG. 3 is a perspective view illustrating the bed frame of FIG. 1 in a fully collapsed state.
Figure 2:
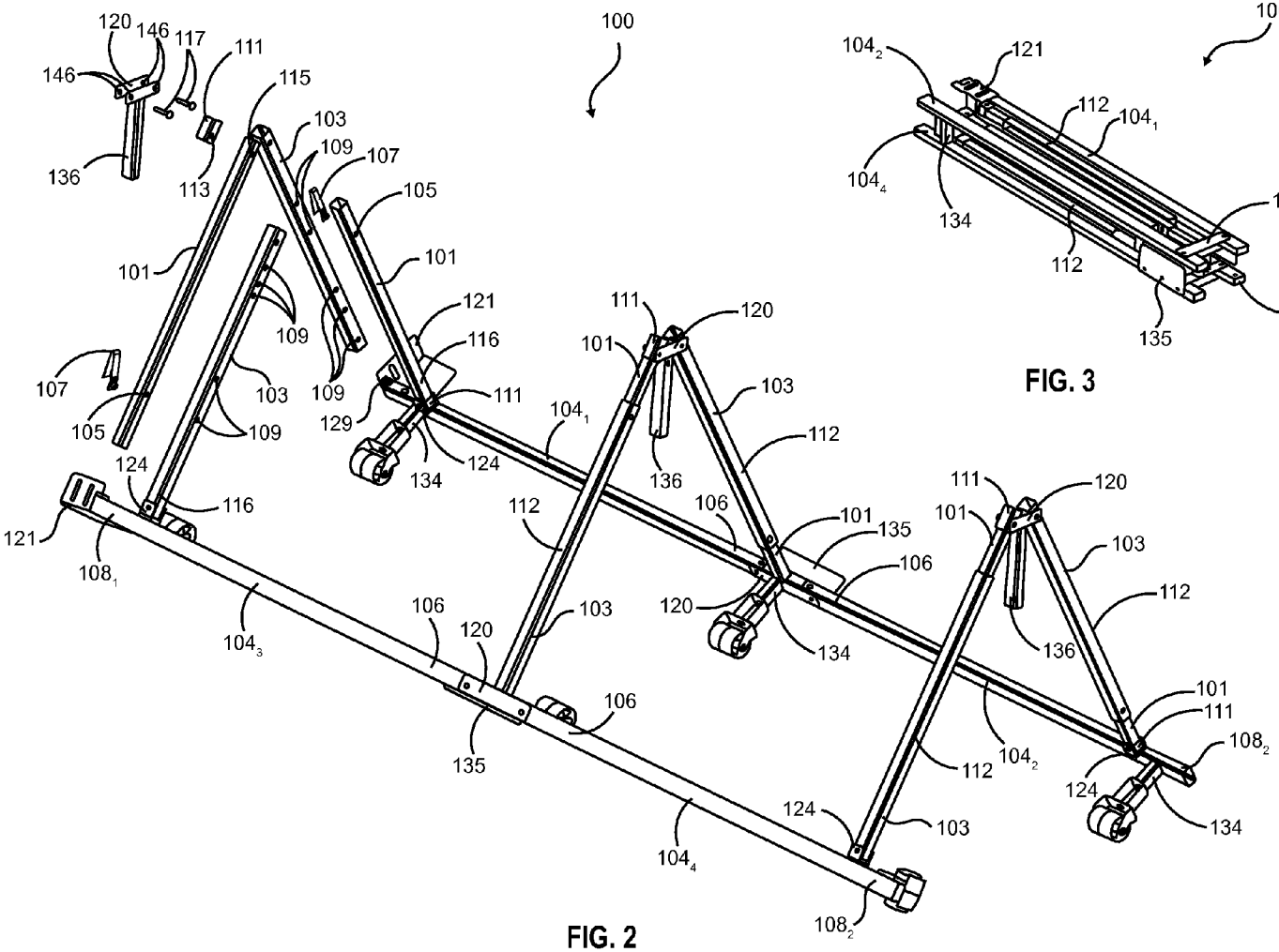
FIG. 2 is a top perspective view illustrating the bed frame of FIG. 1 in a partially collapsed state, and includes an exploded view of a transverse beam.

Referring to FIG. 1, a first embodiment of an adjustable folding bed frame 100 of the present invention in a fully open configuration is shown. FIGS. 2-3 illustrate how the bed frame 100 can be easily folded into a significantly reduced size for convenient transport and/or storage. The bed frame 100 comprises a pair of longitudinal beams 102, three transverse beams 110 and at least four legs 134, 136 (e.g., nine legs shown). The beams and legs 102, 110, 134, 136 are formed with metal and are of rectangular hollow shape to reduce weight while maintaining strength, but one of ordinary skill in the art will recognize that other materials and shapes could be used without departing from the spirit and scope of the invention.

As illustratively shown in its open configuration of FIG. 1, the three transverse beams 110 are spaced apart substantially equidistant from each other and each end is coupled normally to the longitudinal beams 102 to form a substantially rectangular bed frame 100. Specifically a first transverse beam $\mathbf{110}_1$ is coupled between opposing first ends (i.e., free ends $\mathbf{108}_1$) of the longitudinal beams 102, and a second transverse beam $\mathbf{110}_2$ is coupled between opposing second ends (i.e., free ends $\mathbf{108}_2$) of the longitudinal beams 102. Preferably, a third transverse beam $\mathbf{110}_3$ is coupled centrally between the first and second ends $\mathbf{108}_1$, $\mathbf{108}_2$ of the longitudinal beams 102.

Figure 4:
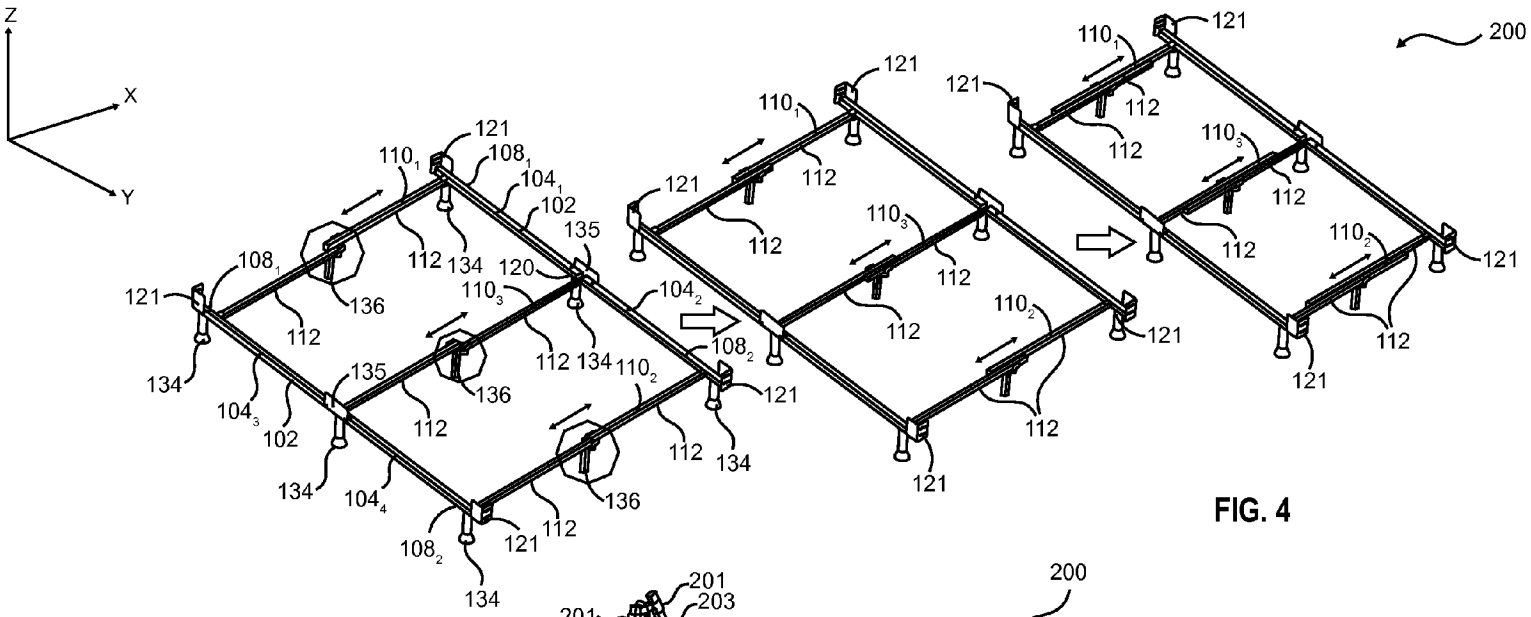
FIG. 4 are top perspective views illustrating a second embodiment of an adjustable folding bed frame of the present invention in a completely expanded state, in three different adjusted widths.
Figure 5:
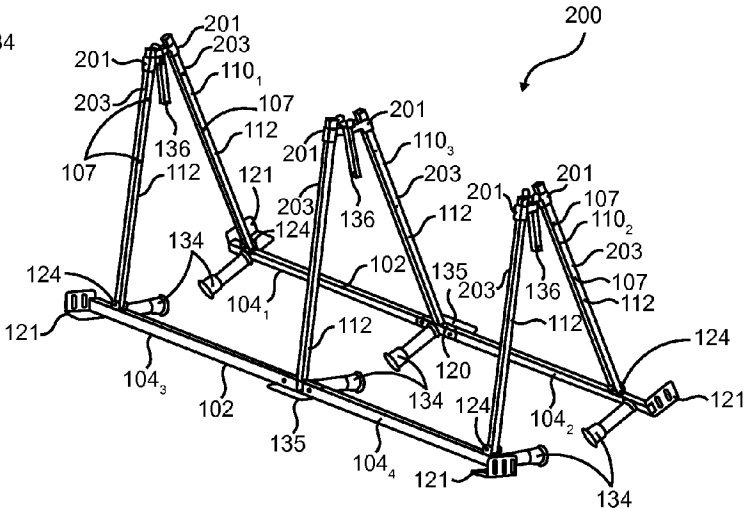
FIG. 5 is a top, left side perspective view illustrating the bed frame of FIG. 4 in a partially collapsed state.

In the preferred embodiment, each outer leg 134 is fixedly attached to lower sides of the free ends of the longitudinal beams 108 and to lower sides of the longitudinal beams 102 between the free ends 108. The outer legs 134 extend downward and are configured for attaching extensions such as wheels (as shown in FIG. 1), glides (stationary extensions), risers (vertically adjustable extensions as shown in FIGS. 4-5) or elongated rectangular hollow extensions such as auxiliary legs 136.

Figure 14:
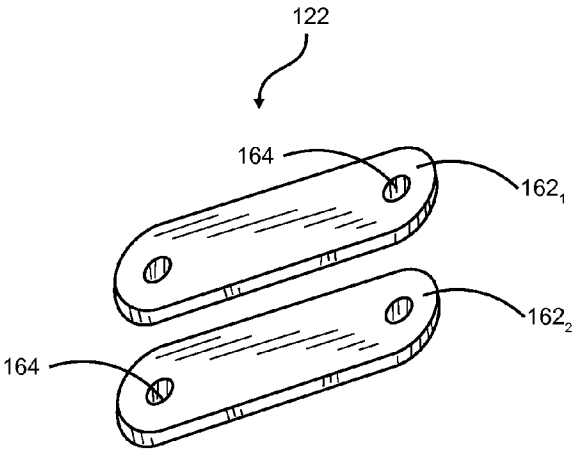
FIG. 14 is a perspective view illustrating a second pivotal coupling member of the present invention.

Each longitudinal beam 102 is formed by a pair of longitudinal bars 104 (e.g., $\mathbf{104}_1$-$\mathbf{104}_4$) having inner ends 106 that are pivotally connected together via a U-shaped first pivotal coupling member 120, and the other ends of each longitudinal bar 104 form the free ends 108 of the longitudinal beams 102. An illustrative first pivotal coupling member 120 is shown and described below with respect to FIG. 13. Alternatively, the longitudinal bar inner ends 106 can be pivotally connected with a second pivotal coupling member 122 which is shown in FIG. 14 and described in more detail below. A groove opening 148 of each first pivotal coupling member 120 (or a space provided between plates 162 of each second pivotal coupling member 122) provides a first plane of motion for the longitudinal bars 104. The first plane of motion is formed along the X-Y plane as shown in FIG. 1, i.e., along the longitudinal axis of the longitudinal beams 102 and extending inwardly approximately 90 degrees towards a transverse bar 112 of the third transverse beam $\mathbf{110}_3$ coupled normally with respect to the longitudinal beams 102.

Figure 13:
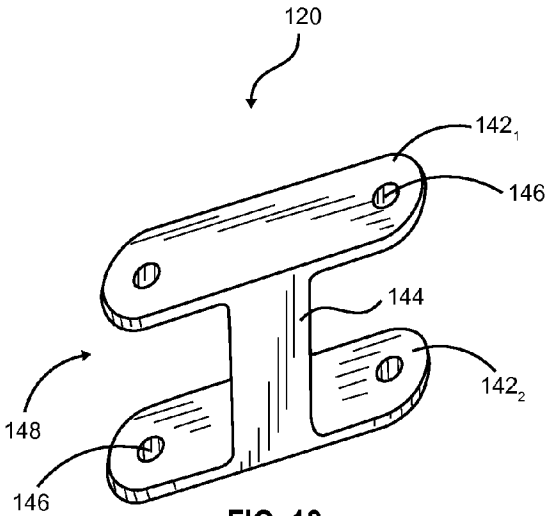
FIG. 13 is a perspective view illustrating a first pivotal coupling member of the present invention.

Referring to FIG. 13, an example of a first pivotal coupling member 120 is illustratively shown. The first pivotal coupling member 120 includes a pair of opposing plates $\mathbf{142}_1$ and $\mathbf{142}_2$ (collectively, opposing plates 142), and an intermediate member 144 attached therebetween along a rear edge of the plates 142 to form a U-shaped bracket. The plates 142 are fixedly spaced apart by the intermediate member 144 a distance suitable for receiving the inner ends 106 of the longitudinal bars 104. The two opposing plates 142 are illustratively shown as being oval in shape, however, such shape and configuration is not limiting. For example, the plates 142 can be shaped rectangular. The area between the plates 142 and interior surface of the intermediate member 144 form a groove opening 148 which faces outwardly with respect to the bed frame while in an open state, and which receives the adjacent inner ends 106 of the longitudinal bars 104. A pair of bores 146 are formed proximate each end of the plates $\mathbf{142}_1$ and $\mathbf{142}_2$, and each pair of opposing bores 146 in each plate 142 are aligned to receive a fastener, such as a bolt, rod or other fastener (not shown), to secure the inner ends 106 of the longitudinal bars 104. Specifically, a pair of bolts or rods extend through the pair of axially aligned bores 146 formed in the opposing plates 142, and each bolt or rod extends through a bore (not shown) formed through the top and bottom walls of each inner end 106 of the longitudinal bars 104. The inner ends 106 of the longitudinal bars 104 pivot about the bolts or rods along the first plane of motion to enable the bed frame 100 to be configured in an open or closed arrangement. The outer portion of the intermediate members 144 faces inwardly and are preferably fixedly attached (e.g., welded, snap fit, secured with a fastener) to second ends 116 of the third transverse beam $\mathbf{110}_3$ of the bed frame 100.

Figure 18:
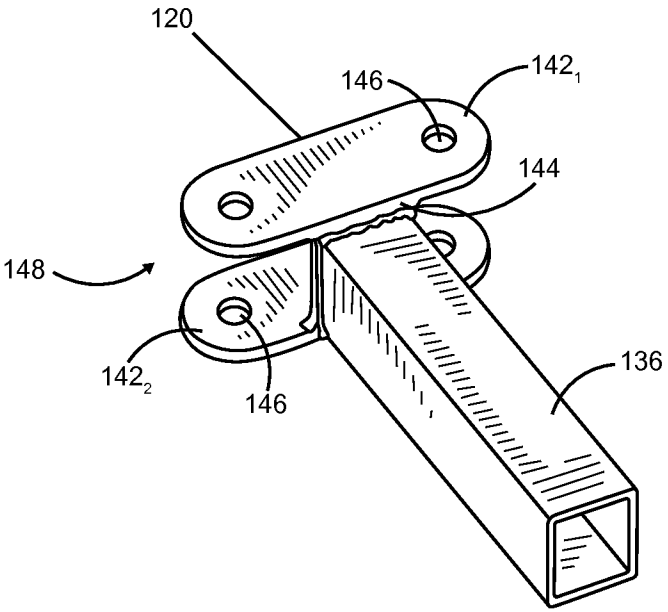
FIG. 18 is a perspective view illustrating a leg assembly fixed to the bottom surface of the first pivotal coupling member.
Figure 17:
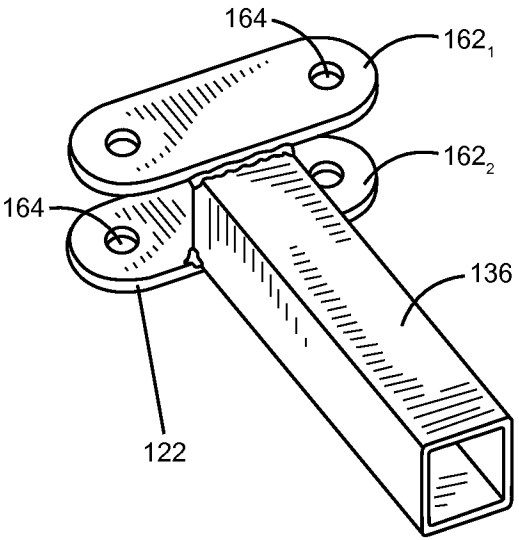
FIG. 17 is a perspective view illustrating a leg assembly fixed to the bottom surface of the second pivotal coupling member.

Similarly, each transverse beam 110 is formed by a pair of transverse bars 112 having first ends 114 pivotally connected together to each side of a U-shaped first pivotal coupling member 120. An auxiliary leg 136 is preferably fixedly attached (e.g., welded, snap fit, secured with a fastener) to each bottom portion of the intermediate members 144 as shown in FIG. 18. Alternatively, the transverse bar first ends 114 of each transverse beam 110 can be pivotally connected with a second pivotal coupling member 122 which includes a pair of plates 162 and is shown and described below with respect to FIG. 14. In this embodiment, each auxiliary leg 136 is fixedly attached (e.g., welded, snap fit, secured with a fastener) to the opposing plates 162 as shown in FIG. 17. Each auxiliary leg 136 is extended to a length substantially similar to the overall length of the outer legs 134 and its attachments but some or all of the legs 134, 136 could be replaced by other extensions such as wheels, glides (stationary extensions) or risers (vertically adjustable extensions).

Each pair of opposing plates 142, 162 provides a second plane of motion for the transverse bars 112. In this embodiment, the plane of motion is formed along the X-Z plane as shown in FIGS. 1 and 2, i.e., along the longitudinal axis of each transverse bar 112 and extending down and inwardly approximately 90 degrees from each transverse bar 112.

Referring to FIG. 14, an example of a second pivotal coupling member 122 is illustratively shown. The second pivotal coupling member 122 includes a pair of opposing plates $\mathbf{162}_1$ and $\mathbf{162}_2$ (collectively opposing plates 162). The plates 162 are illustratively shown as being substantially oval in shape, however, such shape and configuration is not limiting. For example, the plates 162 can be shaped rectangular. A pair of bores 164 are formed proximate each end of the plates $\mathbf{162}_1$ and $\mathbf{162}_2$, and opposing bores 164 in each plate 162 are aligned to receive a fastener, such as a bolt, rod or other fastener (not shown) to secure the opposing sides of the first (inner) ends 114 of the transverse bars 112. The bolt or rod extends through the both plates and the sides of the transverse bars 112 sandwiched therebetween. The first ends 114 of the transverse bars 112 pivot about the bolts or rods along the second plane of motion to enable the bed frame 100 to be configured in an open or closed arrangement.

With further respect to the first and second transverse beams $\mathbf{110}_1$ and $\mathbf{110}_2$, the second opposing ends 116 of each transverse bar 112 are pivotally attached to a side portion of one of the pairs of longitudinal beams 102. In particular, each second end 116 of the first and second transverse beams $\mathbf{110}_1$ and $\mathbf{110}_2$ is pivotally coupled to the free ends 108 of the longitudinal bars 104 by a third pivotal coupling member 118. The third pivotal coupling members 118 are respectively provided along the inner sides of the longitudinal bars 104 proximate the free ends 108, such that an opening 160 of the third pivotal coupling members 118 face inwardly towards each other at the opposing free ends 108 of the longitudinal bars 104. An illustrative third pivotal coupling member 118 is shown and described below with respect to FIG. 15. Alternatively, referring to FIGS. 1 and 16, a fourth pivotal coupling member 124 (described in more detail below) is preferably provided as the means for pivotally coupling the first and second transverse beams 110 to the longitudinal beams 102. The open portion 160 of the third pivotal coupling member 118 (or the open portion between opposing plates 172 of the fourth pivotal coupling members) provides a third plane of motion for the transverse bars 112 of the two transverse beams $\mathbf{110}_1$ and $\mathbf{110}_2$. The third plane of motion is formed along the X-Y plane as shown in FIG. 1, i.e., along the longitudinal axis of the transverse beams 112 and extends inwardly approximately 90 degrees to the longitudinal bars 104.

Figure 15:
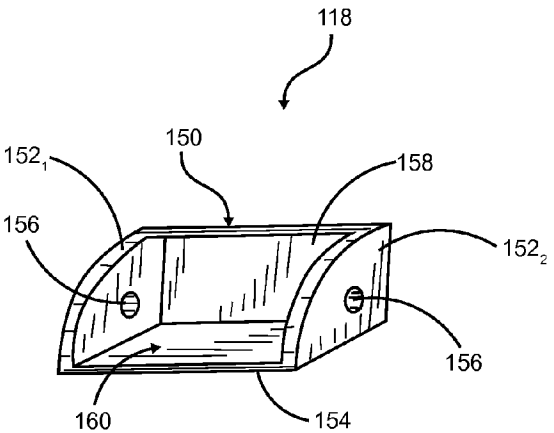
FIG. 15 is a perspective view illustrating a third pivotal coupling member of the present invention.

Referring to FIG. 15, an example of a third pivotal coupling member 118 is illustratively shown. The third pivotal coupling member 118 includes an L-shaped bracket member 150 having a first member 154 affixed substantially orthogonal to a second member 158. First and second side plates $\mathbf{152}_1$ and $\mathbf{152}_2$ (collectively, opposing side plates 152) are affixed to the opposing sides of the L-shaped bracket 150. The side plates 152 can be configured in a quarter-round circular shape and include axially aligned bores 156 dimensioned to receive a bolt, rod or other fastener (not shown). The shape of the side plates 152 is not considered limiting as a rectangular or other curvilinear shape is contemplated. The L-shaped bracket 150 includes an open portion 160 which is dimensioned to receive the second ends 116 of each transverse bar 112 of the first and second transverse beams $\mathbf{110}_1$, $\mathbf{110}_2$. A bolt, rod or other fastener (not shown) extends through the pair of axially aligned bores 156 formed in the opposing plates 152 and the bolt or rod further extends through aligned bores (not shown) formed through the top and bottom walls at the transverse bar second ends 116 of the first and second transverse beams $\mathbf{110}_1$, $\mathbf{110}_2$. The second ends 116 of the transverse bars 112 pivot about the bolt or rod (i.e., axle) along the third plane of motion to enable the bed frame 100 to be configured in an open or closed arrangement. The rear portion of the first member 154 or second member 158 of each third pivotal coupling member 118 is fixedly attached to a corresponding inner side surface of the longitudinal bar 104 at the free end 108, such that the opening 160 of each third pivotal coupling member 118 faces inward towards an opening 160 of an opposing third pivotal coupling member 118. The first member 154 or second member 158 is preferably fixedly attached to the inner side surface of the longitudinal bar 104 by welding, snap fit, secured with a fastener, among other well-known fastening techniques. While closing the bed frame 100, each third pivotal coupling member 118 enables a corresponding transverse bar 112 to rotate approximately ninety (90) degrees inwardly with respect to the longitudinal bars 104.

Specifically, with respect to the two transverse beams $\mathbf{110}_1$ and $\mathbf{110}_2$ located at a front end and a rear end of the bed frame 100, each respective transverse bar 112 is collapsible towards the central portion of the bed frame 100 with respect to the corresponding longitudinal beam 102, as illustratively shown in FIGS. 2 and 3. The direction of rotation of the transverse bars 112 with respect to the longitudinal bars 104 is restricted by the positioning of the opening 160 of the third pivotal coupling member 118, i.e., to permit rotation or folding of the transverse bars 110 only along the longitudinal axis of the longitudinal bars 104.

Figure 16:
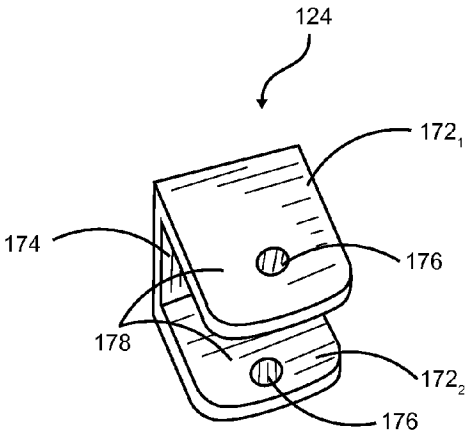
FIG. 16 is a perspective view illustrating a fourth pivotal coupling member of the present invention.

Referring to FIGS. 1, 2 and 16, a fourth pivotal coupling member 124 is preferably used in place of the third pivotal coupling member 118. The fourth pivotal coupling member 124 includes a pair of L-shaped plates $\mathbf{172}_1$ and $\mathbf{172}_2$ (collectively opposing side plates 172), and an intermediate member 174 attached therebetween along a rear edge of the plates 172. The plates 172 are fixedly spaced apart by the intermediate member 174 a distance suitable for receiving the second ends of the transverse bars 116. The transverse bars 112 also provide a plane of motion along the X-Y plane as shown in FIG. 1 (i.e., the third plane of motion), along the longitudinal axis of the transverse bars 112 and extends inwardly 90 degrees to the longitudinal beams 102. An outer surface of the intermediate member 174 is preferably fixedly attached (e.g., welded, snap fit, secured with a fastener) to the second ends of the longitudinal bars 108 at an inner side wall. A pair of bores 176 are formed on the plates $\mathbf{172}_1$ and $\mathbf{172}_2$, and the opposing bores in each plate 176 are aligned to receive a fastener, such as a bolt or rod (not shown) to pivotally secure the transverse bar second ends 112.

Referring to FIGS. 1 and 2, each transverse bar 112 is formed by a first sliding member 101 that is a substantially rectangular hollow shaft slidable within a second sliding member 103 that is a substantially rectangular hollow sleeve. The outer dimensions of the shaft 101 are substantially similar to the inner dimensions of the sleeve 103 such that the shaft 101 is telescoped within the sleeve 103. The shaft 101 includes a locking aperture 105 for receiving a locking member 107 in the form of a biased locking pin which is stored within the shaft 101. The sleeve 103 includes a plurality positioning apertures 109 at predetermined position points, each sleeve aperture 109 corresponding to a separate predetermined relative position or bed frame width. Each sleeve aperture 109 can be labeled with the appropriate predetermined position (e.g., twin, full, queen, king, etc.) so that a user can conveniently adjust the width of the bed frame to a desired position. The length of the locking pin 107 is such that the locking pin 107 extends through the apertures 105, 109 beyond the outer surface of the sleeve 103. A desired predetermined position is attained by aligning and engaging the locking pin 107 and a sleeve aperture 109 corresponding to the desired predetermined position.

Figure 9:
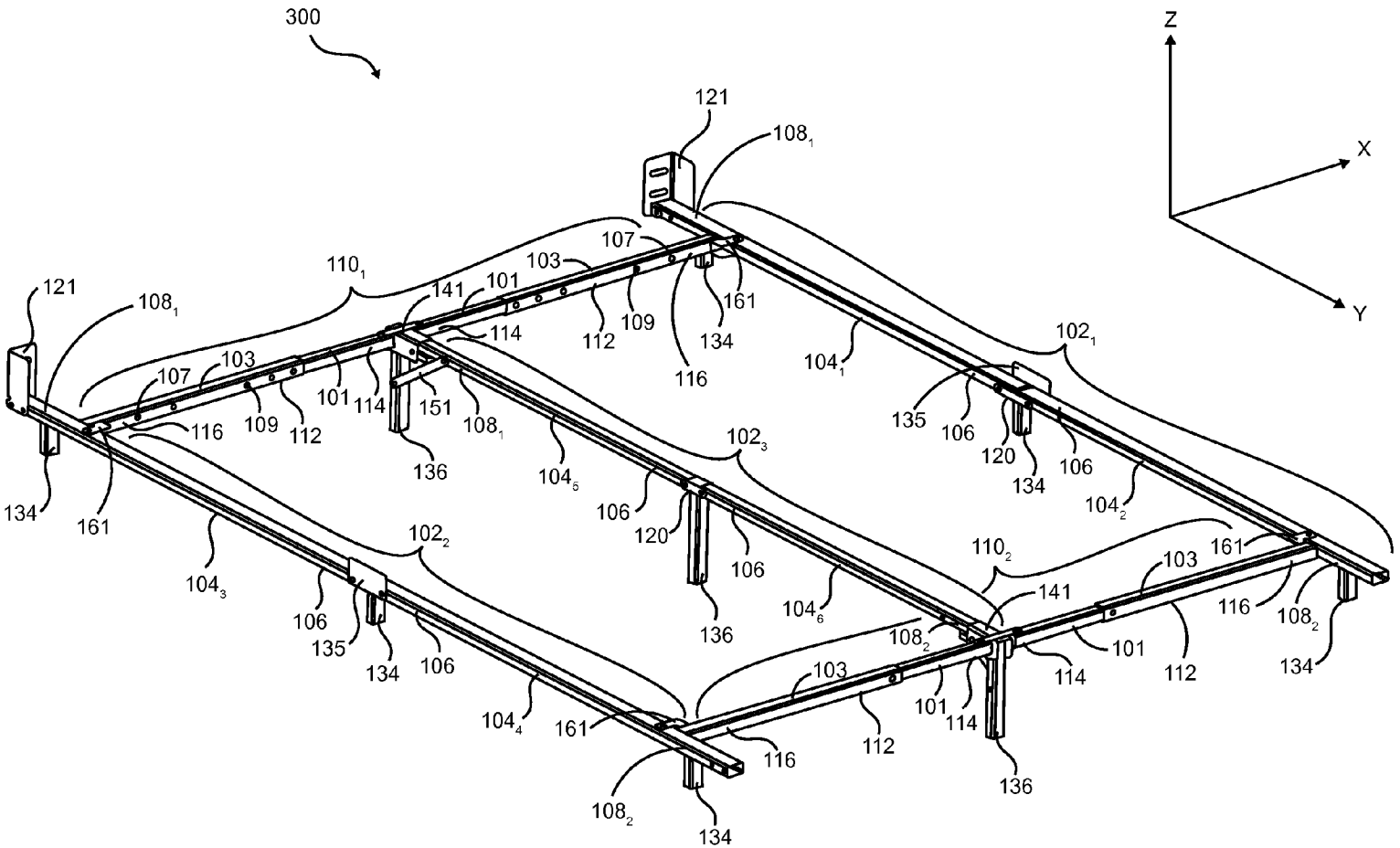
FIG. 9 is a top perspective view illustrating a third embodiment of an adjustable folding bed frame of the present invention in a completely expanded state.

Referring to FIG. 2, each transverse bar 112 further includes a cap 111 which is attached to each shaft 101 distal end (except for the distal end 116 of one of the shafts 101 of the third transverse beam $\mathbf{110}_3$) which is fixedly connected to the longitudinal beam 102 via the first pivotal coupling member 120. The outer dimensions of the cap 111 are substantially identical to the sleeve 103 outer dimensions. The cap 111 is utilized to allow the transverse beams 110 to be uniformly manufactured without altering the sizes of the pivotal coupling members 120, 124. The cap 111 includes opposing apertures 113 corresponding to apertures located at the distal ends of the shaft 115 such that a fastener 117 extends through the apertures as well as the pivotal coupling members 120 and 124. Specifically, for the pivotal connections with the first pivotal coupling member 120, each bolt, rod or other fastener 117 extends through the axially aligned bores 146; the apertures formed through the opposing side walls of the shaft end 115; and the aligned apertures of the cap 113. Similarly, for pivotal connections with the fourth pivotal coupling member 124, each bolt, rod or other fastener (not shown) extends through the axially aligned bores 176; the bores (not shown) formed through the opposing side walls of the shaft end 116; and the aligned apertures (not shown) of the cap 111. One of ordinary skill in the art will recognize that other variations could replace the cap 111 such as washers and the like. The orientation of each transverse bar 112 could also vary. For example, even though in this embodiment the shaft portion 101 of one transverse bar 112 is coupled to a center portion of the bed frame and another the shaft portion 101 of another transverse bar 112 is coupled to an outer portion of the bed frame (as shown in FIG. 1), both shaft portions 101 could be coupled to a center portion of the bed frame as shown in FIG. 9.

Referring to FIG. 1, the bed frame 100 further preferably includes a pair of L-shaped end flanges 121 each formed by an adjoining back plate 123 and a side plate 125. The back plate 123 has slots 127 for attaching the bed frame 100 to a headboard (not shown), and further includes an extension 129 extending normal from the back plate 123 and parallel to the side plate 125. Each end flange 121 is positioned at the outermost end of each longitudinal beam first end $\mathbf{108}_1$ to prevent a box spring or mattress (not shown) from shifting longitudinally past the end flanges 121. Each end flange 121 extends upward and is pivotally connected to each longitudinal beam first end $\mathbf{108}_1$ with a fastener (not shown) which extends through the side plate 125 and the extension 129 such that the end flanges 121 pivot inward ninety degrees when the bed frame 100 is folded (see, e.g., FIG. 3).

The bed frame 100 also includes a pair of side flanges 135 extending upward from an outer side of each longitudinal beam 102 between the free ends 108 at a center portion of the bed frame 100 as shown in FIGS. 1 and 2. Each side flange 135 is preferably rectangular but any other shapes could be used without departing from the spirit and scope of the present invention. The side flanges 135 prevent the box spring or mattress (not shown) from shifting laterally beyond the outer edges of the longitudinal beams 102. The side flanges 135 are pivotally connected to the longitudinal beams by a fastener or the like 137 so that when pivoted 180 degrees, the side flanges 135 extend downward, as shown, for example, in FIG. 3. Such a configuration provides a more compact bed frame 100 in the folded state as shown in FIG. 3. One of ordinary skill in the art will recognize that the bed frame of the present invention could be used without end flanges or side flanges to support other types of mattresses (e.g., air mattresses) that may not conform with the exact dimensions of the bed frame.

FIGS. 2-3 illustrate the folding process of the bed frame 100 of FIG. 1. The general steps for folding the bed frame 100 are substantially similar to the folding steps of the bed frame of the second embodiment of the present invention (shown in FIGS. 4-8) as well as the bed frames shown and described in the '565 application, the parent application for the present invention, which is incorporated by reference in its entirety. The wheels are first detached from the legs 134 of the longitudinal beams 102, and the end flanges 121 and the side flanges 135 are pivoted inward and downward, respectively.

Referring to FIG. 2, the paired second ends 116 of two transverse bars 112 forming each of the three transverse beams 110 are rotated downward inwardly about the first pivotal coupling member 120 until the two longitudinal beams 102 are arranged parallel and adjacent to each other, and each pair of transverse bars 112 extend upward and are arranged parallel and adjacent to each other such that each pair of transverse bars 112 are positioned substantially orthogonal with respect to the longitudinal beams 102. In this manner, the first ends 114 of the transverse bars 112 are rotated about their corresponding pivot points (e.g., bolts or rods 117) on the first pivotal coupling members 120.

The transverse bars 112 at two ends of each longitudinal beam 102 (i.e., transverse beams $\mathbf{110}_1$ and $\mathbf{110}_2$) are rotated inward about the bolt or rod of the fourth pivotal coupling member 124 (i.e., folded along the longitudinal axis of the longitudinal beams 102) and positioned towards the inner sides of the corresponding longitudinal bars 104. In this manner, the transverse bars 112 at two ends of each longitudinal beam 102 are positioned parallel to the respective adjacent longitudinal bars 104 as shown, for example, in FIGS. 4 and 9 of the '565 application.

The free ends $\mathbf{108}_1$ and $\mathbf{108}_2$ of the two longitudinal bars 104 of each longitudinal beam 102 are raised upward towards each other by rotating the longitudinal bars 104 about the corresponding pivot points provided by the first pivotal coupling member 120 connecting the inner ends of the longitudinal bars 106. The longitudinal bars 104 are rotated until they are positioned together in at least a substantially parallel arrangement as shown in FIG. 3. Accordingly, the longitudinal bars 104 and the transverse bars 112 of the bed frame 100 are collectively folded together in a parallel arrangement to significantly reduce the overall footprint of the bed frame 100, thereby making it easier to transport and store.

A person of ordinary skill in the art will appreciate that the bed frame 100 can be opened fully by reversing the folding actions set forth and described above. As described above, the width of the bed frame 100 can be adjusted by disengaging the locking pin 107 of each transverse bar 112; shifting the shaft and sleeve 101, 103 of each transverse bar 112; and engaging the locking pin 107 with a sleeve aperture 109 corresponding to a desired predetermined position. The process of adjusting the bed frame width is simplified when performing while the bed frame 100 is in the partially folded position shown in FIG. 2 due to the closer proximity of the locking pins 107 of each pair of transverse bars 112. It is also advantageous to adjust the bed frame 100 while in the partially folded position because the geometric constraints are minimized compared to adjusting the bed frame 100 in a fully opened configuration as shown in FIG. 1.

Second Embodiment

Referring to FIGS. 4-8, a second embodiment of an adjustable folding bed frame 200 of the present invention is shown. The general opening and folding functions of the bed frame of the second embodiment 200 are identical to the bed frame of the first embodiment 100, i.e., the three planes of motion are the same. However, the method of adjusting the width of the bed frame 200, the structural components of the transverse bars 112 and the pivotal coupling member connecting the transverse bars 112 of each transverse beam 110 differ and will be described in more detail below. The structural components and functions of the bed frame of the second embodiment 200 that are identical to the bed frame of the first embodiment 100 are described above in the description of the first embodiment and is incorporated by reference in this section.

Figure 6:
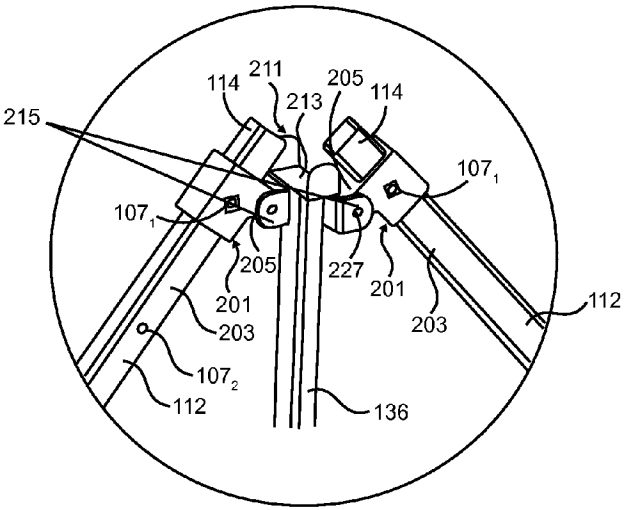
FIG. 6 is a partial side perspective view illustrating opposing transverse bars pivotally coupled by a fifth pivotal coupling member of the bed frame of FIG. 4 which is also shown in more detail in FIG. 19.

Referring to FIG. 6, the transverse bars 112 of each transverse beam 110 include first and second sliding members 203, 201, respectively. The second sliding member 201 is a substantially square hollow sleeve having an aperture on a side wall. The sleeve 201 includes an extension 205 extending normal from a bottom portion which is provided with a bore (not shown) extending axially through the extension 205 substantially parallel to the locking aperture of the sleeve 201.

Referring to FIGS. 5 and 6, the first sliding member 203 is a substantially square and hollow shaft extending the length of the entire transverse bar 112. The outer dimensions of the shaft 203 are equal to or slightly less than the inner dimensions of the sleeve 201 such that the shaft 203 is slidable within the sleeve 201. In this embodiment, the sliding members 201, 203 are metal and hollow to reduce the weight of the bed frame 200 while maintaining strength. One of ordinary skill in the art will recognize that the material and shape of the sliding members 201, 203 could vary without departing from the spirit and scope of the invention.

Figure 7:
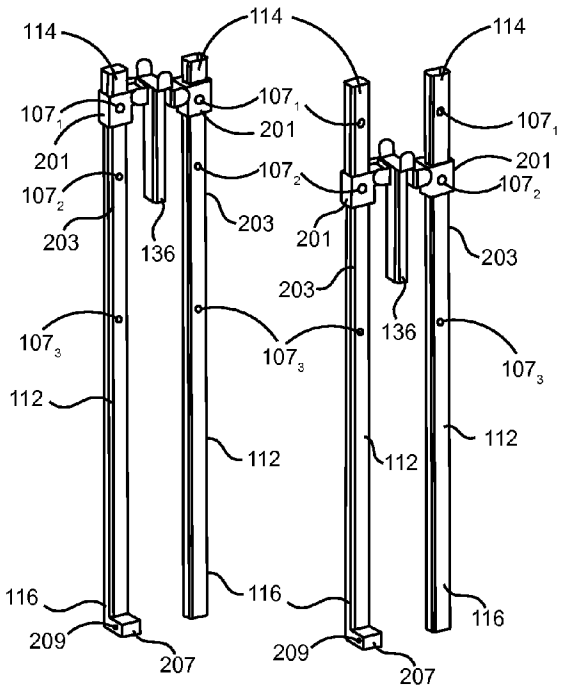
FIG. 7 is a partial side perspective view illustrating opposing transverse bars of the bed frame of FIG. 4 in two different predetermined positions.

Referring to FIG. 7, the shaft 203 includes a plurality of positioning apertures at predetermined position points, each positioning aperture corresponding to a separate predetermined relative position or bed frame width. A plurality of locking members $\mathbf{107}_1$, $\mathbf{107}_2$, $\mathbf{107}_3$ in the form of biased locking pins (collectively, locking pins 107) are stored within the shaft 203 and extend through each shaft aperture. Thus, the locking aperture of the sleeve 201 is engaged with a locking pin 107 corresponding to a desired predetermined width of the bed frame 200. The width of the bed frame 200 is further adjusted to a different desired position by depressing the locking pin 107 to disengage from the locking aperture of the sleeve 201 and sliding the sleeve 201 until a locking pin 107 corresponding to a desired position is engaged with the locking aperture of the shaft 201 as shown, for example, in FIG. 4. One of ordinary skill in the art will recognize that any number of apertures can be formed on the shaft 203 to correspond to any number of bed sizes. Referring to FIG. 7, in this embodiment, the apertures of each opposing shaft 203 corresponding to a predetermined position are equidistant from the first ends 114 of each opposing shaft 203 (i.e., a mirror image). A second end of one transverse bar of each transverse beam 116 (shaft portion 203) includes an extension 207 extending normal to the remaining transverse bar 112 and includes apertures 209 extending through the extension 207 for pivotally connecting to the fourth coupling member 124 (FIG. 16) at a free end of a corresponding longitudinal beam 108 as shown in FIG. 5. Given the side-by-side arrangement of the shafts 203 of each transverse beam 112 (described in more detail below), the extension 207 is provided so that the pivotal connections of the second ends of each transverse bar 116 are aligned transversely. This also allows the longitudinal beams 102 to be uniformly manufactured without changing locations of the fourth pivotal coupling members 124.

Figure 19:
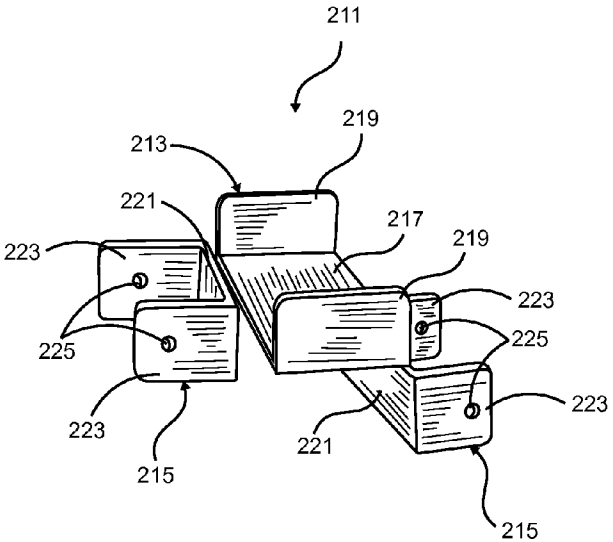
FIG. 19 is a top perspective view illustrating a fifth pivotal coupling member of the present invention.

Referring to FIGS. 6 and 19, the transverse bars 112 of each transverse beam 110 are pivotally connected to each other by a fifth pivotal coupling member 211. Referring to FIG. 19, the fifth pivotal coupling member 211 comprises three U-shaped members. The first U-shaped member is a U-shaped base 213 with a pair of U-shaped extensions 215 each extending laterally from a lower side of opposing lateral sides of the U-shaped base 213. The U-shaped base 213 includes a bottom plate 217 having longitudinal and lateral ends, and a pair of upwardly extending opposing side plates 219. The bottom plate 217 has a width substantially equal to the combined width of the two opposing transverse bar shafts 203 and provides a support surface for the shafts 203 when the bed frame 200 is in the open configuration as shown in FIG. 4. Each U-shaped extension 215 (or second and third U-shaped members) includes a base plate 221 having longitudinal and lateral ends, and a pair of laterally extending opposing side plates 223 having aligned apertures 225. The inner side plates 223 of the U-shaped extensions 215 are substantially aligned along a central lateral axis of the U-shaped base 213. Referring to FIG. 6, a fastener 227 (such as a bolt, screw or rod) extends through the aligned sleeve apertures (not shown) and corresponding side extension apertures 225 to provide a pivotal connection for each transverse bar 112. An auxiliary leg 136 is further fixed (welded, snap fit, or secured with a fastener) to the bottom portion of fifth pivotal coupling member 211 to provide additional support to the interior portions of the bed frame 200.

The structural configuration of the sleeve and shaft 201, 203 as well as the fifth pivotal coupling member 211 provide the bed frame 200 with further advantages in the width adjustment process. Referring to FIG. 7, when the bed frame 200 is in a partially folded configuration, the width of each transverse beam 110 can be easily adjusted without any geometrical constraints and without affecting the remaining bed frame 200 because the opposing apertures and locking pins $\mathbf{107}_1$, $\mathbf{107}_2$, $\mathbf{107}_3$ corresponding to each specific predetermined position are aligned laterally. Therefore, adjusting the width of the bed frame 200 simply requires the user to depress each opposing locking pin 107 and sliding the sleeve 201 to a desired new pair of locking pins 107.

Referring to FIGS. 4 and 5, end flanges 121 and side flanges 135 are pivotally coupled to each free end and midpoint of the longitudinal beams 108, respectively, as described in the first embodiment above, but one with ordinary skill in the art will recognize that less than four end flanges 121 could be used without departing from the spirit and scope of the invention.

Figure 8:
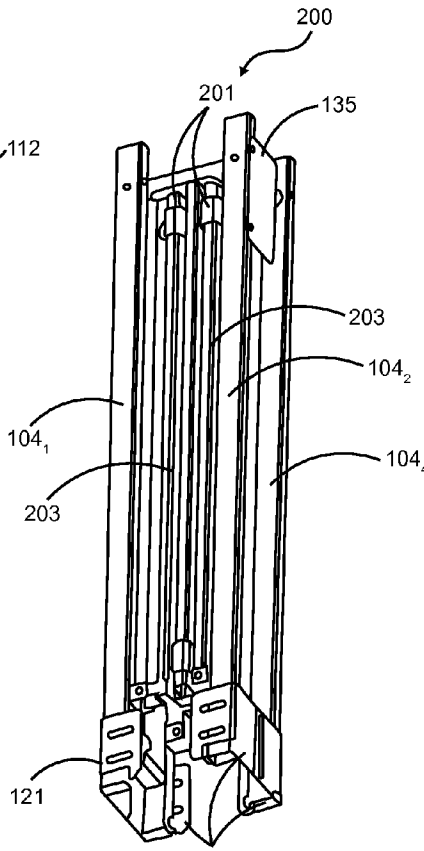
FIG. 8 is a perspective view illustrating the bed frame of FIG. 4 in a fully collapsed state.

The bed frame 200 is folded from a fully opened configuration as shown in FIG. 4 to a fully folded configuration as shown in FIG. 8 in a similar manner as described above in the description of the bed frame of the first embodiment 100. That is, the leg extensions are detached from the outer legs 134; from the open configuration shown in FIG. 4, the transverse bars 112 are rotated down and inward about the fifth pivotal coupling member 211 along the X-Z plane (the second plane of motion) as shown in FIG. 5; from the partially folded configuration shown in FIG. 5, the outer transverse beams $\mathbf{110}_1$ and $\mathbf{110}_2$ are rotated inward about the fourth pivotal coupling members 124 toward the longitudinal bars 104 along the Y-Z plane; and the longitudinal bars 104 are rotated inward about the first pivotal coupling member 120 toward the third transverse beam $\mathbf{110}_3$ along the Y-Z plane as shown in FIG. 8.

Third Embodiment

Figure 10:
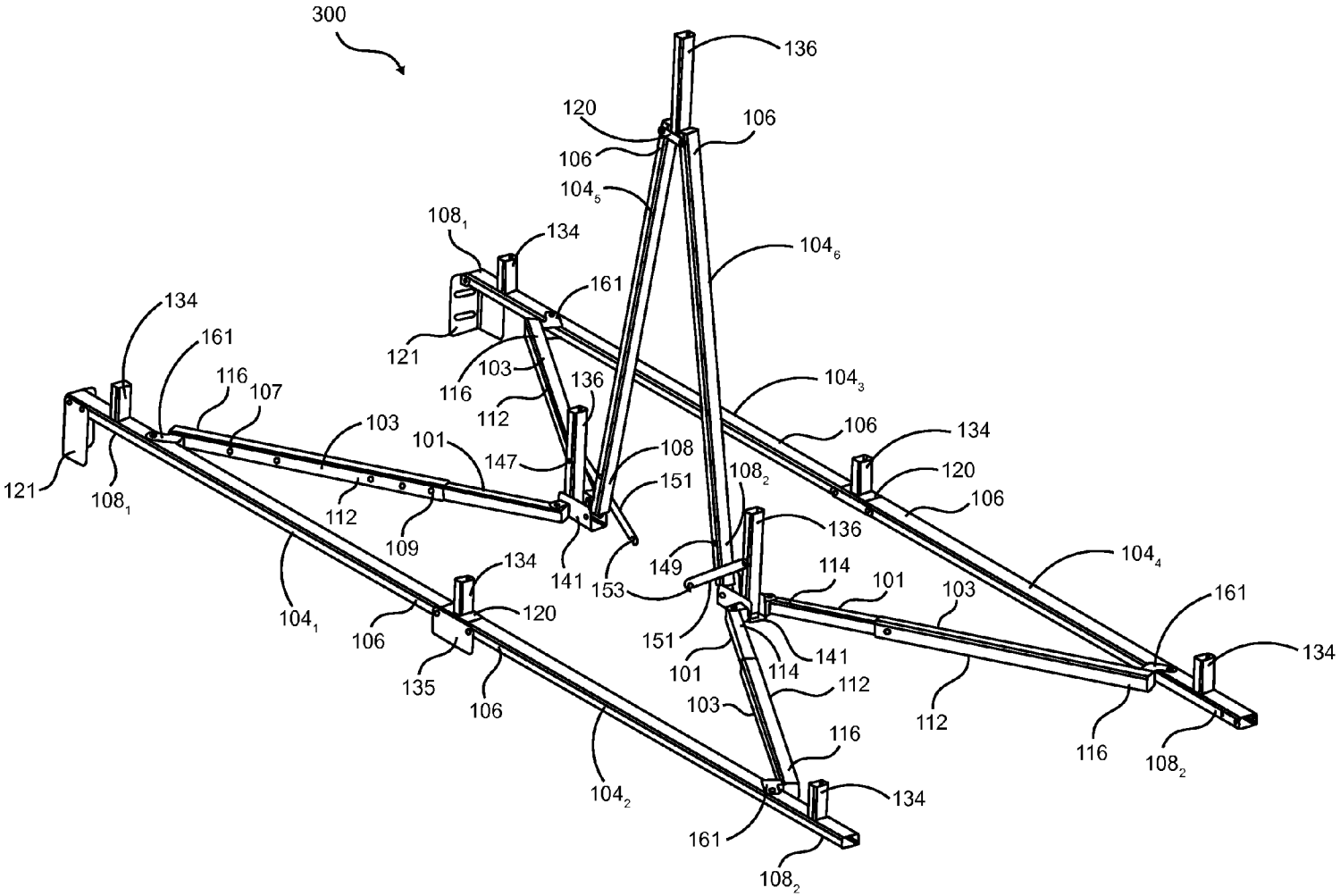
FIG. 10 is a bottom perspective view illustrating a first collapsing operation of the bed frame of FIG. 9.
Figure 11:
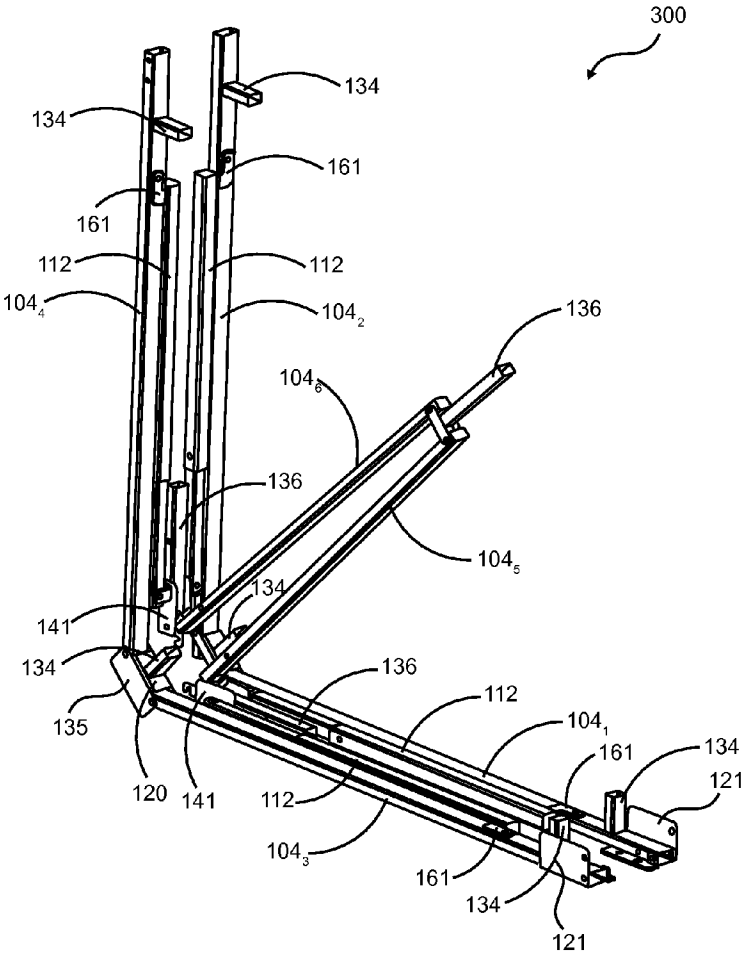
FIG. 11 is a bottom perspective view illustrating a second collapsing operation of the bed frame of FIG. 9.
Figure 12:
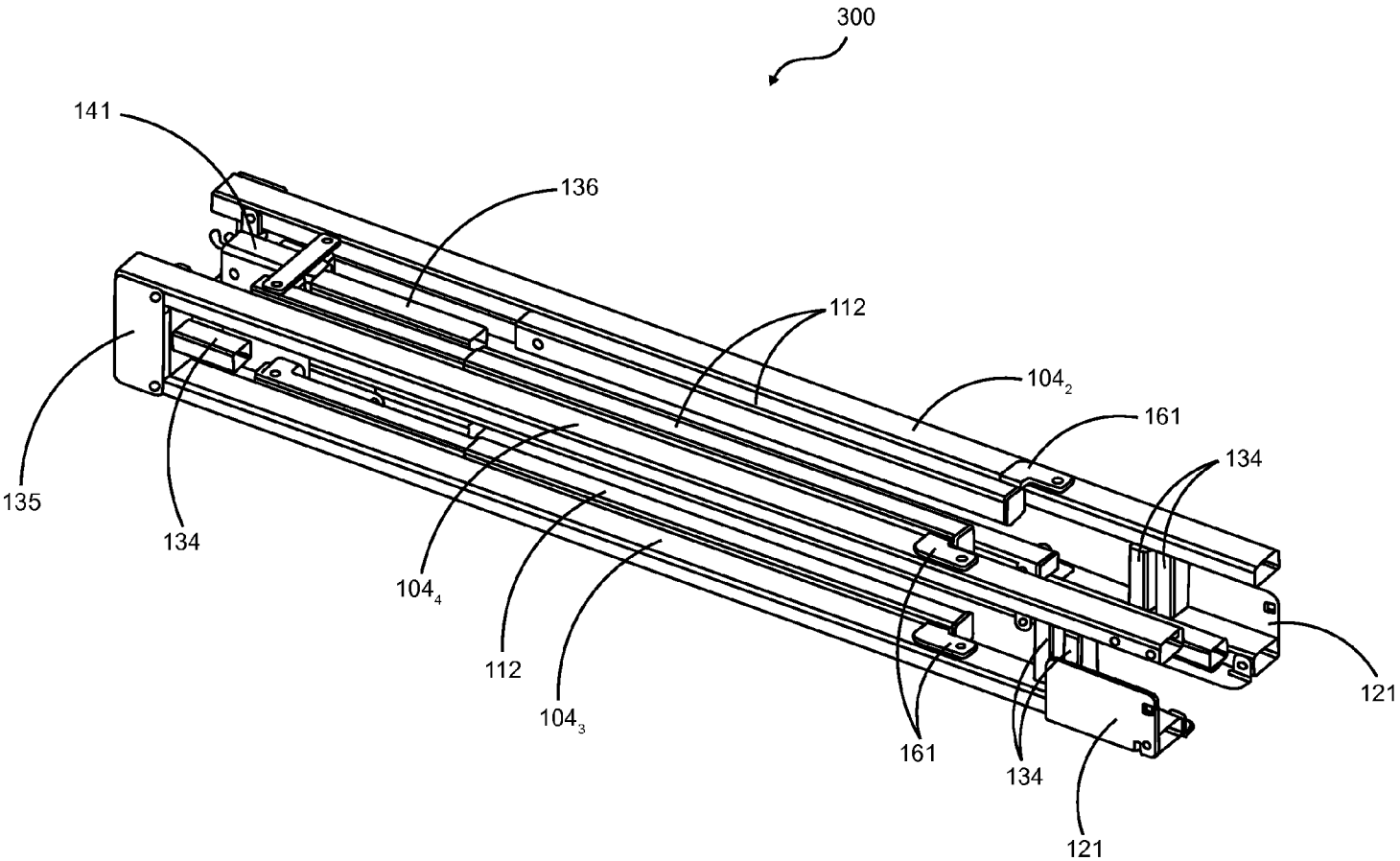
FIG. 12 is a perspective view illustrating the bed frame of FIG. 9 in a fully collapsed state.

Referring to FIGS. 9-12, an adjustable folding bed frame 300 of the third embodiment of the present invention is illustratively shown. FIG. 9 illustrates the bed frame 300 in a fully open configuration and FIGS. 10-12 illustrate how the bed frame 300 can be easily folded into a significantly reduced size for convenient transport and/or storage. The bed frame 300 comprises three longitudinal beams $\mathbf{102}_1$, $\mathbf{102}_2$, $\mathbf{102}_3$ (collectively, 102) two transverse beams $\mathbf{110}_1$, $\mathbf{110}_2$ (collectively, 110) and at least four legs 134, 136 (e.g., nine legs shown). The beams and legs 102, 110, 134, 136 are formed with metal and are of rectangular hollow shape to reduce weight while maintaining strength, but one of ordinary skill in the art will recognize that other materials and shapes could be used without departing from the spirit and scope of the invention.

As illustratively shown in its open configuration of FIG. 9, the two transverse beams 110 are spaced apart and each end is coupled normally to the outer longitudinal beams 102 to form a substantially rectangular bed frame 300. Specifically a first transverse beam $\mathbf{110}_1$ is coupled between opposing first ends (i.e., free ends $\mathbf{108}_1$) of the outer longitudinal beams $\mathbf{102}_1$, $\mathbf{102}_2$ and a second transverse beam $\mathbf{110}_2$ is coupled between opposing second ends (i.e., free ends $\mathbf{108}_2$) of the outer longitudinal beams $\mathbf{102}_1$, $\mathbf{102}_2$. Preferably, a third longitudinal beam $\mathbf{102}_3$ is coupled to the transverse beams 110 centrally between outer ends of each transverse beam 116.

In the preferred embodiment, each outer leg 134 is fixedly attached to lower sides of the free ends 108 of the outer longitudinal beams $\mathbf{102}_1$, $\mathbf{102}_2$ and to lower sides of the outer longitudinal beams $\mathbf{102}_1$, $\mathbf{102}_2$ between the free ends 108 of each outer longitudinal beam $\mathbf{102}_1$, $\mathbf{102}_2$. The outer legs 134 extend downward and are configured for attaching extensions such as wheels (as shown in FIG. 1), glides (stationary extensions), risers (vertically adjustable extensions as shown in FIGS. 4-5) or a continuous rectangular hollow extension such as the auxiliary legs 136.

Each longitudinal beam 102 is formed by a pair of longitudinal bars 104 (e.g., $\mathbf{104}_1$-$\mathbf{104}_6$) having inner ends 106 that are pivotally connected together via the U-shaped first pivotal coupling member 120. An illustrative first pivotal coupling member 120 is shown and described above with respect to FIG. 13. Alternatively, the longitudinal bar inner ends 106 can be pivotally connected with the second pivotal coupling member 122 which is shown in FIG. 14 and described in more detail above. The groove opening 148 of each first pivotal coupling member 120 (or the space provided between plates 162 of each second pivotal coupling member 122) provides two separate planes of motion for the longitudinal bars 104 as shown in FIGS. 9-11. Specifically, with respect to the outer longitudinal bars $\mathbf{104}_{1\text{-}4}$, the plane extends along the longitudinal axis of each longitudinal bar $\mathbf{104}_{1\text{-}4}$ from the first pivotal coupling member 120 and extends down and inward approximately 90 degrees along the Y-Z plane to form a fourth plane of motion. With respect to the inner longitudinal bars $\mathbf{104}_{5\text{-}6}$, the plane extends along the longitudinal axis of each longitudinal bar $\mathbf{104}_{5\text{-}6}$ from the first pivotal coupling member 120 and extends upward approximate 90 degrees along the Y-Z plane to form a fifth plane of motion.

In this embodiment, referring to FIG. 13, the plates 142 of the first pivotal coupling member 120 are fixedly spaced apart by the intermediate member 144 a distance suitable for receiving the inner ends 106 of the longitudinal bars 104. The area between the plates 142 and interior surface of the intermediate member 144 form a groove opening 148 which faces upwardly with respect to the bed frame while in an open state, and which receives the adjacent inner ends 106 of the longitudinal bars 104. A fastener, such as a bolt, rod or other fastener (not shown) secure the inner ends 106 of the longitudinal bars 104. Specifically, a pair of bolts or rods extend through the pair of axially aligned bores 146 formed in the opposing plates 142, and each bolt or rod extends through a bore (not shown) formed through the inner and outer side walls of each inner end 106 of the longitudinal bars 104. The inner ends 106 of the longitudinal bars 104 pivot about the bolts or rods along the Y-Z plane (the fourth and fifth planes of motion) as described above to enable the bed frame 300 to be configured in an open or closed arrangement. The space provided on each side of the groove opening 148 allows the longitudinal bars 104 to pivot downward to a position normal to the intermediate member 144 when the bed frame 300 is in a folded state as shown in FIGS. 11 and 12. The bottom portion of each intermediate member 144 faces downwardly and an outer leg 134 is preferably fixedly attached (e.g., welded, snap fit, secured with a fastener), as shown, for example, in FIG. 18. In the alternative, when the second pivotal coupling member 122 is used to pivotally couple the longitudinal bars 104, each leg 134 is fixed to a bottom portion of the plates 162 of the second pivotal coupling member 122 as shown, for example, in FIG. 17.

Referring to FIG. 9, each transverse beam 110 is formed by a pair of transverse bars 112 which are described in detail above with respect to the first embodiment. In the present embodiment, the shafts 101 are located at the first ends of the transverse bars 114 and the sleeves 103 are located at the second ends of the transverse bars 116. The transverse bar first ends 114 of each transverse beam are pivotally connected together with a sixth pivotal coupling member 141 as illustratively shown in FIG. 20.

Figure 20:
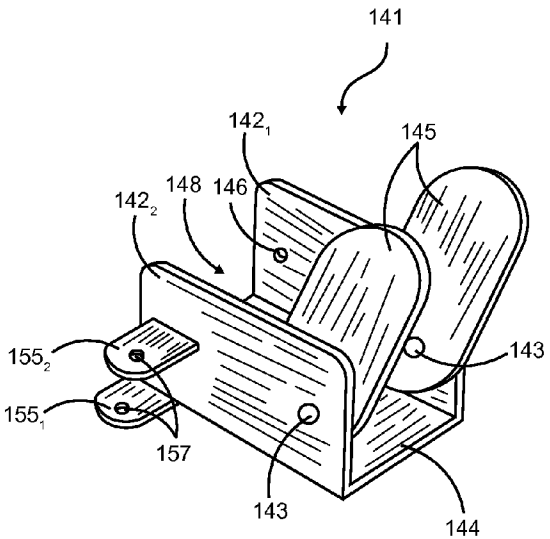
FIG. 20 is a bottom perspective view illustrating a sixth pivotal coupling member of the present invention.

Referring to FIG. 20, an example of a sixth pivotal coupling member 141 is shown. The sixth pivotal coupling member 141 provides pivotal connections for the transverse beam first ends 114 as well as the outer ends 108 of the third longitudinal beam $\mathbf{102}_3$. The sixth pivotal coupling member 141 includes a pair of opposing plates $\mathbf{142}_1$, $\mathbf{142}_2$ and an intermediate member 144 attached therebetween along top edges of the plates $\mathbf{142}_1$, $\mathbf{142}_2$ to form a central U-shaped bracket similar to that of the first pivotal coupling member 120 shown in FIG. 13, except that the intermediate member 144 fully extends along the top edges of the plates $\mathbf{142}_1$, $\mathbf{142}_2$. The two opposing plates $\mathbf{142}_1$, $\mathbf{142}_2$ are illustratively shown as being substantially rectangular in shape, however, such shape and configuration is not limiting. For example, the plates can be shaped oval. The plates $\mathbf{142}_1$, $\mathbf{142}_2$ are fixedly spaced apart by the intermediate member 144 a distance suitable for receiving the outer ends 108 of the longitudinal bars 104 of the third longitudinal beam $\mathbf{102}_3$ and an auxiliary leg 136. The area between the plates $\mathbf{142}_1$, $\mathbf{142}_2$ and interior surface of the intermediate member 144 form a groove opening 148 which faces downwardly with respect to the bed frame 300 while in an open state, and which receives the outer ends 108 of each longitudinal bar $\mathbf{104}_5$, $\mathbf{104}_6$ and an auxiliary leg 136.

A pair of bores 146 are formed proximate each outer end of the plates 142 and each pair of opposing bores 146 are aligned to receive a fastener, such as a bolt, rod or other fastener (not shown) to secure an auxiliary leg 136. Specifically, a bolt or rod extends through the pair of axially aligned bores 146 formed in the opposing plates 142 and a bore (not shown) formed through the side walls of each auxiliary leg 136 to form a pivotal connection.

An additional pair of bores (not shown) are formed proximate each inner end of the plates 142 to pivotally secure an outer end 108 of each longitudinal bar $\mathbf{104}_5$, $\mathbf{104}_6$. In the present embodiment, a fastener (e.g., a bolt or rod) 143 extends through each axially aligned bore (not shown) formed on each plate 142 and through a bore (not shown) formed through an extension plate 145 to form a pivotal connection. Each extension plate 145 is fixedly coupled (e.g., welded, snap fit, secured with a fastener) to the outer side walls of each outer end 108 of the longitudinal bars $\mathbf{104}_5$, $\mathbf{104}_6$. Alternatively, the side walls of each outer end 108 of the longitudinal bars $\mathbf{104}_5$, $\mathbf{104}_6$ can be provided with aligned bores and directly pivotally coupled to the opposing plates 142 by a continuous fastener.

The outer ends 108 of the longitudinal bars $\mathbf{104}_5$, $\mathbf{104}_6$ pivot about the fastener of each sixth pivotal coupling member 141 along the Y-Z plane (the fifth plane of motion) as described above and the auxiliary legs 136 pivot about the fastener of each sixth pivotal coupling member 141 along a Y-Z plane of motion as shown in FIGS. 9-12 (i.e., a sixth plane of motion along a longitudinal axis of the auxiliary leg 136 from the sixth pivotal coupling member 141 extending along the Y-Z plane approximately ninety degrees outward) to enable the bed frame 300 to be configured in an open or closed arrangement. Each auxiliary leg 136 is extended to a length substantially similar to the overall length of the outer legs 134 and its attachments but some or all of the legs 134, 136 could be replaced by other extensions such as wheels, glides (stationary extensions) or risers (vertically adjustable extensions).

Referring to FIG. 10, opposing side walls of each auxiliary leg 136 further includes opposing and aligned apertures 147 and each corresponding longitudinal bar $\mathbf{104}_5$, $\mathbf{104}_6$ further includes a protrusion 149 (i.e., a bar or rod) extending from a corresponding side wall. An elongated flange 151 is pivotally coupled to the auxiliary leg aperture 147 on one end and a hook 153 is located on an opposing end of the elongated flange 151 such that the hook 153 engages the protrusion 149 when the bed frame 300 is in an open state to provide further stability to the center of the bed frame 300. The hook 153 is disengaged and aligned with the auxiliary leg 136 when the bed frame 300 is in the folded state as shown in FIGS. 11 and 12.

Referring again to FIG. 20, each sixth pivotal coupling member 141 further includes a pair of side extensions $\mathbf{155}_1$, $\mathbf{155}_2$ extending from outer sides of the plates $\mathbf{142}_1$, $\mathbf{142}_2$ for receiving first ends of the transverse bars 114. In this embodiment, the side extension extending from the top portion of the U-shaped bracket $\mathbf{155}_1$ is a continuous plate extending the width of the sixth pivotal coupling member 141 and is fixed to the top surface of the intermediate member 144, as shown in FIG. 9, to provide additional stability to the pivotal connection of the transverse bars 112. The pair of side extensions $\mathbf{155}_1$, $\mathbf{155}_2$ includes opposing and aligned apertures 157. The top and bottom walls of each transverse bar inner end 114 also include corresponding aligned bores (not shown) such that the side extensions 155 and transverse bar inner ends 114 are coupled with a continuous bolt or rod (not shown) extending through the apertures 157 and bores to provide a pivotal connection.

Figure 21:
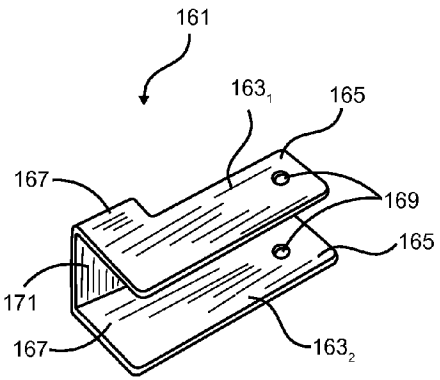
FIG. 21 is a perspective view illustrating a seventh pivotal coupling member of the present invention.

Referring to FIGS. 9 and 10, the second ends of each transverse bar 116 are pivotally coupled to the outer ends 108 of corresponding outer longitudinal bars $\mathbf{104}_{1\text{-}4}$ by a seventh pivotal coupling member 161 as shown in FIG. 21. The seventh pivotal coupling member 161 includes two opposing L-shaped plates $\mathbf{163}_1$, $\mathbf{163}_2$. Each L-shaped plate includes an elongated portion 165 having proximal and distal ends, and a transverse portion 167 extending normal from the proximal end of the elongated portion 165. The elongated portion 165 distal end includes opposing and aligned apertures 169. An intermediate member 171 extends from the outer edges of the opposing transverse portions 167. An inner side of the intermediate member 171 provides an engaging surface for the longitudinal bars 104 when the bed frame 300 is in a folded state as shown in FIGS. 11 and 12. Referring to FIGS. 9 and 10, an outer side of the intermediate member 171 is fixedly coupled to a side wall of each transverse bar second end 116 and each elongated portion 165 distal end is pivotally coupled to a corresponding longitudinal bar $\mathbf{104}_{1\text{-}4}$ outer end 108 by extending a fasteners (e.g., screw, rod or the like) through the apertures of the elongated portion distal ends 169 and bores (not shown) formed on the longitudinal bar $\mathbf{104}_{1\text{-}4}$ outer ends 108. Thus, the plane of motion for the transverse bars 112 is formed along the X-Y plane and extends 180 degrees from an aligned position, as shown in FIG. 9, to a position where the transverse bars 112 are parallel and adjacent to each other as shown in FIG. 11, a seventh plane of motion.

The bed frame 300 of the third embodiment also includes end flanges 121 and side flanges 135, which are described in detail above in the description of the bed frame 100 of the first embodiment.

In operation, referring to FIG. 10, to fold the bed frame 300, the hooks 153 of the elongated flanges 151 are detached from the protrusions 149 of the inner longitudinal bars $\mathbf{104}_5$, $\mathbf{104}_6$. The paired second ends 116 of the two transverse bars 112 forming each of the two transverse beams 110 are rotated inwardly about the seventh pivotal coupling member 161 and the inner longitudinal bars $\mathbf{104}_5$, $\mathbf{104}_6$ are rotated downwardly about the sixth pivotal coupling member 141. The outer longitudinal bars $\mathbf{104}_1$, $\mathbf{104}_3$ and $\mathbf{104}_2$, $\mathbf{104}_4$, corresponding transverse bars 112, corresponding auxiliary legs 136 and corresponding elongated flanges 151 are arranged parallel and adjacent to each other; and the inner longitudinal bars $\mathbf{104}_5$ and $\mathbf{104}_6$ are arranged parallel and adjacent to each other to form three separate groupings as shown in FIG. 11. The outer groupings (i.e., the outer longitudinal bars $\mathbf{104}_1$, $\mathbf{104}_3$ and $\mathbf{104}_2$, $\mathbf{104}_4$ are then folded inwardly toward the inner longitudinal bars $\mathbf{104}_5$, $\mathbf{104}_6$ about their respective first pivotal coupling members 120. The end flanges 121 and the side flanges 135 are rotated inward and downward, respectively. Thus, the longitudinal bars 104 and the transverse bars 112 are positioned together in at least a substantially parallel arrangement as shown in FIG. 12 to significantly reduce the overall footprint of the bed frame 300, thereby making it easier to transport and store.

A person of ordinary skill in the art will appreciate that the bed frame 300 can be opened fully by reversing the folding actions set forth and described above. As described above in the description of the bed frame of the first embodiment 100, the width of the bed frame 300 can be adjusted by disengaging the locking pin 107 of each transverse bar 112; shifting the shaft and sleeve 101, 103 of each transverse bar 112; and engaging the locking pin 107 with a sleeve aperture 109 corresponding to a desired predetermined position. The process of adjusting the bed frame width is simplified when performed while the bed frame 300 is in the partially folded position as shown in FIG. 11 due to the closer proximity of the locking pins 107 of opposing transverse bars 112 of each transverse beam 110.

The present invention illustrates three adjustable folding bed frame embodiments 100, 200 and 300, each of which are constructed such that both the longitudinal beams 102 and the transverse beams 110 of the bed frames 100, 200, 300 are formed by pairs of axially aligned bars (i.e., longitudinal bars 104 and transverse bars 112) which are pivotally connected together medially along their respective longitudinal axis. Further, the longitudinal beams 102 are pivotally connected to the transverse beams 110 so that when the bed frames 100, 200, 300 are folded to a reduced size, each of the longitudinal and transverse bars can be folded compactly together in three folding steps and the overall dimensions of the folded bed frames 100, 200, 300 can be minimized to a configuration that not only facilitate reduced storage space but also makes transporting the bed frames 100, 200, 300 easier.

While the foregoing is directed to embodiments of the present invention, other and further embodiments of the invention can be devised without departing from the basic scope thereof, and the scope thereof is determined by the claims that follow.

What is claimed is:

1. A foldable bed frame comprising:

first and second longitudinal beams spaced apart and parallel to each other, each longitudinal beam formed by a pair of longitudinal bars each having a free end and an inner end, adjacent inner ends of each respective pair of longitudinal bars pivotally connected together by a first pivotal coupling member;

first, second and third transverse beams spaced apart and parallel to each other, the third transverse beam disposed between the first and second transverse beams, each transverse beam formed by a pair of transverse bars having a first end and a second end, each transverse bar formed by a first sliding member slidingly coupled with a second sliding member, adjacent first ends of each respective pair of transverse bars pivotally connected together by a second pivotal coupling member, wherein opposing transverse bar second ends of each of the first and second transverse beams are pivotally connected to corresponding longitudinal bar free ends of the first and second opposing longitudinal beams by a third pivotal coupling member, and opposing transverse bar second ends of the third transverse beam are each fixedly connected to the first pivotal coupling member of the opposing longitudinal beams such that the longitudinal and transverse beams form a generally rectangular frame in an open configuration; and a plurality of legs, at least one leg connected to a lower side of each longitudinal bar proximate the free ends;

wherein the bed frame is folded from the open configuration to a folded configuration by:

rotating the pair of transverse bars of each transverse beam downward with respect to each respective second pivotal coupling member in a first plane of motion such that the second pivotal coupling members move upward with respect to the transverse bars to a position where the transverse bars of each transverse beam are substantially parallel and adjacent to each other, and the opposing longitudinal beams are substantially parallel and adjacent to each other;

rotating each of the transverse bars of the first and second transverse beams downward with respect to each respective third pivotal coupling member in a second plane of motion such that each pair of transverse bars of each of the first and second transverse beams are substantially parallel and adjacent to corresponding longitudinal bars; and rotating each pair of opposing longitudinal bars upward with respect to each respective first pivotal coupling member in a third plane of motion such that the first pivotal coupling members move downward with respect to the longitudinal bars to a position where the transverse bars and longitudinal bars of the bed frame are collectively substantially parallel and adjacent to each other.

* * * * *